US006918138B2

(12) United States Patent
Donovan

(10) Patent No.: US 6,918,138 B2
(45) Date of Patent: Jul. 19, 2005

(54) HEATED SHOWER CAP

(76) Inventor: James A. Donovan, 8805 Roberts Rd., Odessa, FL (US) 33556

( * ) Notice: Subject to any disclaimer, the term of this patent is extended or adjusted under 35 U.S.C. 154(b) by 0 days.

(21) Appl. No.: 10/672,102

(22) Filed: Sep. 26, 2003

(65) Prior Publication Data

US 2005/0050611 A1 Mar. 10, 2005

Related U.S. Application Data

(63) Continuation-in-part of application No. 10/656,744, filed on Sep. 5, 2003.

(51) Int. Cl.[7] ..... A41B 1/04
(52) U.S. Cl. ..... 2/174; 2/204
(58) Field of Search ..... 2/174, 171, 68, 2/202, 200.1, 204, 209.13; 206/581; 4/516, 519; 132/212, 206; 34/96; 607/109–110; 428/27, 79; 283/97; 424/70.1

(56) References Cited

U.S. PATENT DOCUMENTS 2,493,363 A * 1/1950 Loran ..... 34/95.1
2,781,764 A * 2/1957 Miller ..... 132/212
3,349,825 A * 10/1967 Andreadis ..... 607/110
3,951,127 A * 4/1976 Watson et al. ..... 126/206
4,061,898 A * 12/1977 Murray et al. ..... 219/211
4,382,446 A * 5/1983 Truelock et al. ..... 607/110
4,459,471 A * 7/1984 Hulett et al. ..... 219/527
4,725,462 A * 2/1988 Kimura ..... 428/29
4,815,144 A * 3/1989 Martin ..... 2/7
5,143,048 A * 9/1992 Cheney, III ..... 126/263.04
5,197,292 A * 3/1993 McPherson ..... 62/56
5,265,278 A * 11/1993 Watanabe ..... 2/174
5,275,156 A * 1/1994 Milligan et al. ..... 607/114
5,327,585 A * 7/1994 Karlan ..... 2/7
5,469,579 A * 11/1995 Tremblay et al. ..... 2/7
5,557,807 A * 9/1996 Hujar et al. ..... 2/171.2
5,773,802 A * 6/1998 Graves ..... 219/759
5,850,636 A * 12/1998 Reuven ..... 2/174
5,950,234 A * 9/1999 Leong et al. ..... 2/7
5,956,759 A * 9/1999 Benedict ..... 2/7
6,047,706 A * 4/2000 Skiba et al. ..... 132/200
6,080,690 A * 6/2000 Lebby et al. ..... 442/209
6,103,139 A * 8/2000 Kohout ..... 252/70
6,125,474 A * 10/2000 Gillette ..... 2/171.2
6,182,294 B1 * 2/2001 Pulley ..... 2/171
6,351,852 B1 * 3/2002 Propp ..... 2/174
6,481,021 B2 * 11/2002 Spell ..... 2/209.13
2003/0126670 A1 * 7/2003 Graneto, III ..... 2/174
2003/0185779 A1 * 10/2003 Mitsumatsu et al. ..... 424/70.1
2003/0233697 A1 * 12/2003 Tsai ..... 2/209.13

* cited by examiner

*Primary Examiner*—Alissa L. Hoey
(74) *Attorney, Agent, or Firm*—John S. Munday

(57) ABSTRACT

A liner for a shower cap has a chamber or ampoule containing a predetermined quantity of a supercooled liquid exotherm compound and a small amount of the compound in the crystal form, such that the crystal and the liquid are separated until time for use. Upon action by the user, such as by bending or otherwise breaking the separation between the crystal and the liquid, an exothermic reaction takes place as the liquid crystallizes, releasing a known amount of heat to cause the towel to warm. Calcium carbonate is the preferred compound. A temperature indicator may also be included as part of the packaging. A hair cleaning compound is provided, such as a shampoo, hair conditioner, hair moisturizer, scalp conditioning agents or mixtures.

4 Claims, 2 Drawing Sheets

HEATED SHOWER CAP

This application is a continuation-in-part of U.S. Ser. No. 10/656,744, filed Sep. 5, 2003.

FIELD OF THE INVENTION

This invention relates to a cap that can be worn in the shower or other places where the user wished to keep her or his hair from becoming wet. More particularly, the invention relates to shower cap in which an exothermic reaction contained within the cap generates sufficient heat to warm a cleaner and conditioner in the cap to cleanse and condition the users' hair.

BACKGROUND OF THE INVENTION

Caps that are worn in the shower to keep one's hair dry are not new. Some caps may be made of synthetic materials that are water impervious and may be used in the shower, as a protection from rain, or as a bathing cap for swimming in a pool or other body of water. The cap may be decorated to give added visual appeal.

Shower caps have been modified to include additional features. U.S. Pat. No. 5,987,967 discloses a shower cap with a pouch for long hair. U.S. Pat. No. 5,455,970 discloses a shower cap using an elastic band to maintain the positioning of the cap.

In some instances, it is desirable to apply heat to one's hair. U.S. Pat. No. 4,061,898 discloses a shower cap that includes electric heating elements to facilitate drying the user's hair. U.S. Pat. No. 6,425,403 describes a shower cap which may be used with a hand-held, hot-air blower or hair drier. U.S. Pat. No. 5,773,802 discloses a shower cap with multiple layers, one of which is intended to absorb heat from a microwave device and retain sufficient heat to warm the head or hair of the user. The heat is retained by a lossy dielectric material.

All of the prior art shower caps that use heat in any form are complicated and involve generation of heat that is potentially dangerous to the user. Electricity, hot air and microwave energy may not necessarily be controlled at a safe temperature to be applied to the head.

Some people, such as those who have very greasy hair, prefer to use a dry shampoo on days they do not use aa water based shampoo. This is done to keep their hair looking clean and avoiding a greasy look. The may also use a scalp toner or scalp stimulator to reduce the number of times per week that hair is washed. One formula for a dry shampoo is a small amount of talc wet with rosemary oil, tea tree oil and lavender oil mixed in a blender.

Other products using shower caps are available that contain a shampoo for cleaning hair when water is not available. These are used in hospitals, nursing homes, and in the privacy of one's own home. One such product is Comfort Hair™ Rinse Free Shampoo Cap with Conditioner, said to be the first complete, one-step hair care system in a convenient, microwavable cap. By eliminating the need to rinse, the mess is eliminated. One thoroughly cleans and condition a patient's hair without the rinsing with water. In order to avoid a cold sensation on the scalp and to provide soothing warmth, these products are designed to be placed in a microwave to be heated, hopefully to a comfortable temperature. They require the device be heated in the kitchen, which may not be where the user wants to shampoo her or his hair.

The use of supercooled liquids has been an available technology for over 100 years for generating an exothermic reaction under controlled circumstances. U.S. Pat. Nos. 4,872,442 and 4,889,953 to Manker disclose the use of activators to initiate crystallization or destabilization of a super-cooled aqueous salt solution to cause the generation of heat in a heat pack. Stainless steel, beryllium-copper alloys and phosphor-bronze alloys are used. Hettle et al. U.S. Pat. No. 5,056,589 also uses stainless steel to trigger thermal energy packs to release heat from super-cooled solutions. Cheney U.S. Pat. No. 5,143,048 discloses an infant heel warmer using supercooled solutions of sodium acetate and hydroxyethyl cellulose together, along with a disk or ampoule that contains sodium acetate crystals that are released when the disk or ampoule is broken to expose the solution to the crystals. Finally, Milligan et al. U.S. Pat. No. 5,275,156 teaches a reusable device in which a trigger causes crystallization of materials such as sodium acetate tetrahydrate by contact with rigid objects, such as small spheres, wherein the rolling action of the spheres is said to produce crystallization of the solution.

It would be a great advantage if a device for use with a shower cap could be made that would have no metal or other contaminating components as the crystallization inducing element.

Another advantage would be to provide a shower cap system that is self-heating and contains a cleaner and/or conditioner for the hair.

Yet another advantage of the present invention is that it provides a way of cleaning and conditioning one's hair that is simple to manufacture and is inexpensive to produce. Other advantages will appear hereinafter.

SUMMARY OF THE INVENTION

It has now been discovered that the above and other objects of the present invention may be accomplished in the following manner. The unique aspect of this invention is the ability to initiate an exothermic reaction without the use of metal or other components, such that the exotherm begins using a small quantity of the solid form of the compound. Preferred materials are sodium acetate and sodium carbonate, with the latter being most preferred.

In it's simplest form the invention comprises a single or dual chamber plastic ampoule or like structure, similar to a straw or other breakable object that contains an exotherm to create a heat pack. Once crushed or broken the chamber releases the active ingredient, such as the aforementioned sodium acetate or sodium carbonate, though other exotherms may be employed. Simply fold the pouch (thus breaking the ampoule), then place the cap on the head and massage the outside of the cap. Inside will be a warmed gentle, rinse-free solution which saturates the hair, cleansing and conditioning at the same time. When finished, remove the cap and style the hair as usual. The cap is disposable so there's no mess. It's the easiest shampoo ever!

The exotherm is a super cooled liquid that is also quite stable as a liquid. By crushing or breaking the plastic structure, a few molecules are forced to flip to the solid state, and the rest of the liquid then rushes to solidify as well. This causes the temperature of the solidifying liquid to jump to a controlled temperature up to 130° F. in the process. The preferred method to causes the crystallization is by adding a tiny bit of crystal from a protected source. Once released it would cause the exothermic heat reaction.

This released reaction then causes the material with which it is associated to be heated. The released heat would be controlled by the quantity of exotherms contained in the breakable object. This source would be placed between natural fibers, synthetic fibers, synthetic material and combinations thereof, and once crush or broken would cause a reaction to become heated. In the present invention, the ampoule or the like is inside a thermal liner made of such materials that has been formed into a liner for a conventional shower cap. Preferably the ampoule is centered in the cap and liner such that it becomes positioned on the head at the center of the person's hair.

In order to determine the temperature, the cap itself would have a heat sensitive ink or indicator that could be of any material that would change color when the correct temperature is reached. The package may also have a label or strip made of a material capable of indicating the rise of the temperature. These indicators could also be placed on the front of the cap to indicate temperature or rise in temperature in use. If the ink or indicator changes color with increased temperature, a trademark, for example, could reach a new color when the towels are ready for use, and a warning label would change color if the temperature exceeded a desired or predetermined limit. The indicator should preferably be visible to the user in a mirror or the like during use.

The fibrous liner that contains the ampoule may also contain a shampoo and/or hair conditioner that is warmed by the exotherm. After putting on the cap and having the exotherm warm the cap, the user may massage the cap to cause the hair treatment to take place. It is intended that any shampoo and any hair conditioner that can be applied from a fibrous sheet as used herein is within the scope of the present invention.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 4:
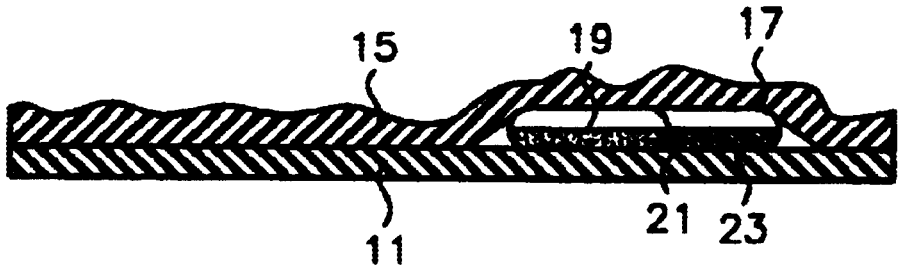
FIG. 4 is a section view taken along the line 3—3 of FIG. 3.

As shown in the figures, the device 10 is a conventional shower cap 11 on a person 13 desiring to keep her or his hair dry in a wet environment such as a shower or bath. The cap 11 includes a liner 15 inside the cap and positioned to contact the hair of the user. Inside the liner 15 is a small ampoule 17 as seen in FIG. 4.

For the purpose of this invention, the term cap is defined as any of the water impervious caps well known for use in commercial and consumer products. These caps are available in a variety of shapes, sizes, colors and may have designs or images printed or molded thereon.

The liners of the present invention are heated by an exothermic reaction of supercooled liquid crystallizing into a solid form. Any such material that has the ability to initiate an exothermic reaction without the use of metal or other components may be used. Preferred materials are sodium acetate and sodium carbonate, with the latter being most preferred.

Figure 1:
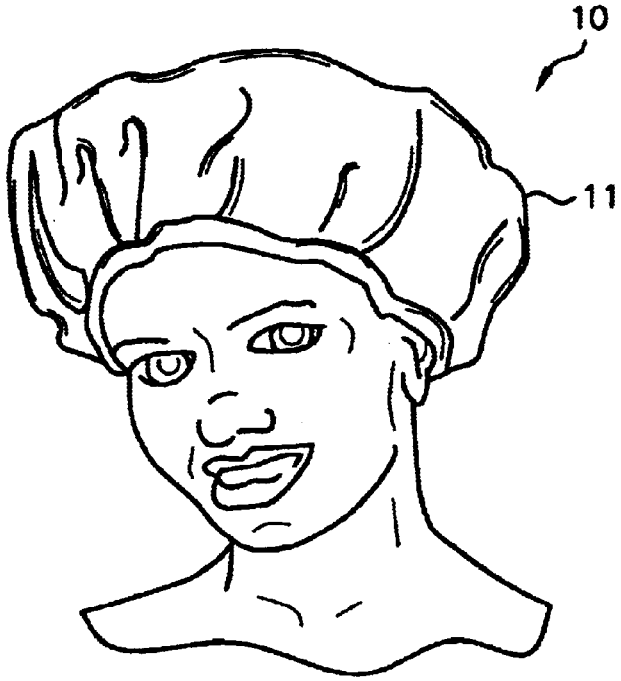
FIG. 1 is a perspective view of the preferred embodiment of the invention shown in place on a person.

The container or ampoule 17 of the present invention is formed from plastic, straw, or any other material that can be easily fractured or broken to release the small amount of crystal for contact with the liquid. Ampoule 17 is placed in the middle of a stack of towels 11, as seen if FIG. 1. Then the entire stack of folded towels is placed in a package for shipment, storage, display and purchase. The user then takes the package and uses one or more towels as needed.

Ampoule 17 is formed from plastic or other materials that are suitable for keeping a liquid such as supercooled liquid 19 on one side of ampoule 17 and separated from the other side by a liquid impervious barrier 21. In the other side of ampoule 17 is a small quantity 23 of the crystal form of the supercooled liquid. When ampoule 17 is flexed, it breaks and the crystal 23 mixes in the liquid 19 because barrier 21 has been broken or removed by the twisting action. This initiates the exothermic reaction and heat is transferred to the liner 15 and to the person wearing the cap.

Figure 2:
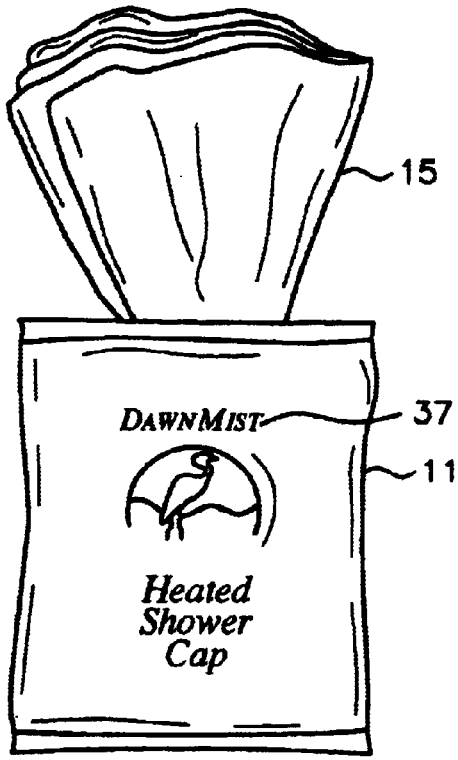
FIG. 2 is a side elevational view of the device illustrating the use of indicia thereon.
Figure 3:
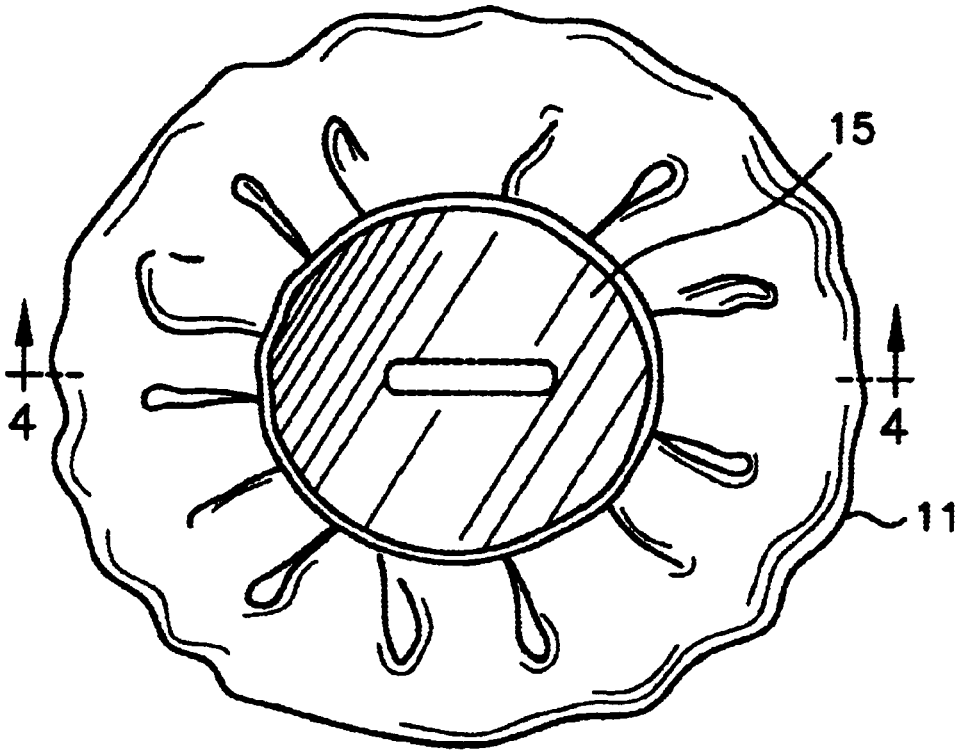
FIG. 3 is a bottom plan view of the device shown in FIG. 1.

In FIG. 2, one preferred packaging element is shown. Cap 11 includes a temperature indicator 37 which advances in color as the temperature increases in order to inform the user of the degree of exotherm. In FIG. 2, the temperature indicator 37 is printed in the form of a trademark lettering to advertise the product, but a separate thermometer scale could also be employed.

The ampoule 17 is broken by flexing the cap and liner until the user senses that the ampoule has snapped or broken. The user will also feel heat beginning to be released in the form of a crystallization exotherm by the supercooled liquid inside the ampoule. When the indicator 37 shows the temperature for use has been reached, the cap 11 is put on as needed. These temperature indicating labels 37 have in inbuilt adhesive that can be attached to the outside label to indicate and record the temperature. When the temperature is increasing as the nominated temperature is exceeded, the label color will change to show the number of temperature increments that have been reached or exceeded. The indicator has a permanent recording function so that the maximum temperature reaches is always recorded.

Such labels are available commercially. Technical Industrials Inc. manufactures and sells such products, which have the name Temperature Recording Labels in the industry. It is also contemplated to use Irreversible Temperature Paint/Inks, which would be used to print the labels, such as the logo shown in the drawings, and once the ampoule was broken, the rising heat would change the color in the name. Once the whole name turned a desired color, the cap will be used. Alternatively, the ampoule can be broken to begin the exothermic reaction after the cap is on the person's head. The user can monitor the increase in temperature by viewing the change in color as it progresses.

It is intended that the device of this invention include a hair conditioning agent, which includes shampoo, hair conditioner, hair moisturizer, scalp conditioning agents and mixtures thereof. While any shampoo or cleaning solution may be used by incorporating it into the liner 15, two common formulae are used for illustrating the efficacy of the present invention.

The first formula is a very basic detergent cleansing wipe, which is simply a mild detergent solution for a non-woven fabric. It contains polysorbate 20, glycerin, d-Panthenol, Witch Hazel Distillate, and deionized water. Perfumes, preservatives, and color may be used as well. To make the solution, pre-blend the perfume and polysorbate 20, then combine remaining components and heat to 65 to 70° C. Add the pre-blend and stir to cool. One can also add a small amount of a mild detergent, such as 0.5 to 1.0% Aqua and Sodium Lauroyl Sarcosinate to achieve better cleaning properties.

The second formula is a lotion wipe, in which the detergent is replaced by a very fine particle size emulsion which possesses both cleansing and superfatting properties. The fine particle size of the emulsion prevents separation of the emulsion during wicking up the non-woven fabric and gives it a stable end product. The inclusion of botanical or superfatting/moisturizing agents enhances the skin feel. The formula includes Cetearyl Octanote, Isopropyl Myristate, Octyl Palmitate, Cetearyl Stearate, Mineral Oil, Sorbitan Stearate, Polysorbate, Stearate, Dow Corning 344 Volatile Silicone Fluid or Cyclomethicone, and dionized water. Once again, perfumes, preservatives, and color are added as desired. It is formulated by heating the oil and water phases separately to 65 to 70° C. The water phase is added to the oil phase slowly while stirring, then stir to cool.

Simply fold the pouch (thus breaking the ampoule), then follow the instructions on the package. Place the Cap on the head and massage the outside of the cap. Inside will be a warmed gentle, rinse-free solution which saturates the hair, cleansing and conditioning at the same time.

When finished, remove the cap and style the hair as usual. The cap is disposable so there's no mess.

While particular embodiments of the present invention have been illustrated and described, it is not intended to limit the invention to any specific embodiment. The description of the invention is not intended to limit the invention.

What is claimed is:

1. A device for cleaning a person's hair, comprising:

an outer cap having a water impervious outer surface and sized to fit over the hair of a person;

a liner positioned inside said outer cap, said liner having a fibrous texture and being sized to contact the hair of the person;

a quantity of hair cleaning compound in said liner; and a heat source, said heat source comprising a frangible container containing a quantity of supercooled liquid capable of releasing a predetermined amount of heat upon crystallization and a quantity of the crystal form of said liquid separated from said supercooled liquid selected from the group consisting of sodium carbonate and sodium acetate and present in an amount sufficient to initiate crystallization of said quantity of supercooled liquid upon flexing said frangible container to cause said crystal to contact at least a portion of said supercooled liquid; and a temperature sensitive portion on said cap to indicate the temperature of the cap after breaking said frangible container;

wherein said crystallization causes the temperature of the solidifying liquid to reach a controlled temperature of up to 130° F. and said hair cleaning compound is in contact with the user's hair.

2. The device of claim 1, wherein said liner is formed from materials selected from the group consisting of natural fibers, synthetic fibers, synthetic materials and combinations thereof.

3. The device of claim 1, wherein said hair cleaning compound is selected from the group consisting of shampoo, hair conditioner, hair moisturizer, scalp conditioning agents and mixtures thereof.

4. The device of claim 1, wherein said frangible container being placed proximate the middle of said plurality of liner to provide heat to said liner and cap.

* * * * *